US011260419B2

(12) United States Patent
Johnson

(10) Patent No.: US 11,260,419 B2
(45) Date of Patent: Mar. 1, 2022

(54) METHOD FOR COATING A STRUCTURE WITH A FUSION BONDED MATERIAL

(71) Applicant: Innovation Calumet LLC, Valparaiso, IN (US)

(72) Inventor: Gary R. Johnson, Gary, IN (US)

(73) Assignee: INNOVATION CALUMET LLC, Valparaiso, IN (US)

( * ) Notice: Subject to any disclaimer, the term of this patent is extended or adjusted under 35 U.S.C. 154(b) by 0 days.

(21) Appl. No.: 16/290,500

(22) Filed: Mar. 1, 2019

(65) Prior Publication Data

US 2019/0270114 A1 Sep. 5, 2019

Related U.S. Application Data

(60) Provisional application No. 62/638,046, filed on Mar. 2, 2018.

(51) Int. Cl.
*B05D 1/24* (2006.01)
*B05C 3/09* (2006.01)
*B05D 1/00* (2006.01)

(52) U.S. Cl.
CPC ..... *B05D 1/24* (2013.01); *B05C 3/09* (2013.01); *B05D 1/007* (2013.01)

(58) Field of Classification Search
CPC ..... B05C 19/025; B05C 3/09; B05C 9/14; B05D 1/00; B05D 1/007; B05D 1/02; B05D 1/04; B05D 1/24; B05D 3/0218; B05D 7/14; B05D 7/20
See application file for complete search history.

(56) References Cited

U.S. PATENT DOCUMENTS 3,289,704 A * 12/1966 Nicosia ..... B29C 44/1295 138/155
3,566,833 A * 3/1971 Beebe ..... H01B 13/0033 118/634
3,593,678 A * 7/1971 Miller ..... H01J 9/225 118/630
3,708,321 A * 1/1973 Spieles et al. ..... B05D 5/068 427/470
3,832,974 A * 9/1974 Adams ..... B05C 19/02 118/408

(Continued)

*Primary Examiner* — Alexander M Weddle
(74) *Attorney, Agent, or Firm* — GrowIP Law Group LLC

(57) ABSTRACT

The disclosure provides example methods and a system that includes: (a) a fluidization bed having a reservoir and comprising a base and a plurality of side walls, (b) an epoxy-based powder disposed within the reservoir, where the fluidization bed is configured to fluidize the epoxy-based powder, (c) a first heating element configured to heat the wire matrix reinforcement to at least a melting temperature, (d) a conveyor positioned over the fluidization bed and configured to engage the wire matrix reinforcement, where the conveyor is configured to submerge the wire matrix reinforcement into the fluidized epoxy-based powder such that a portion of the epoxy-based powder melts and coats the wire matrix reinforcement, and where the conveyor is configured to remove the wire matrix reinforcement from the epoxy-based powder; and (e) a second heating element configured to cure the epoxy-based powder coating the wire matrix reinforcement into a corrosion resistant barrier.

7 Claims, 4 Drawing Sheets

(56) References Cited

U.S. PATENT DOCUMENTS

| | | | | | |
|---|---|---|---|---|---|
| 4,040,993 | A * | 8/1977 | Elbling | C08G 59/226 | 523/427 |
| 4,440,800 | A * | 4/1984 | Morton | B22F 1/025 | 427/459 |
| 4,723,759 | A * | 2/1988 | Patrick | E04H 17/161 | 256/22 |
| 4,726,567 | A * | 2/1988 | Greenberg | E04B 2/16 | 256/19 |
| 5,031,290 | A * | 7/1991 | Brereton | C23F 13/02 | 29/6.1 |
| 5,518,546 | A * | 5/1996 | Williams | B05B 5/1683 | 118/621 |
| 2003/0091735 | A1* | 5/2003 | Baumann | H02K 15/12 | 427/180 |
| 2005/0218393 | A1* | 10/2005 | Larsen | E04H 17/161 | 256/32 |
| 2006/0062929 | A1* | 3/2006 | Kittle | B05C 19/025 | 427/475 |
| 2010/0126413 | A1* | 5/2010 | Ris | B01J 2/16 | 118/300 |
| 2015/0240113 | A1* | 8/2015 | Pratt | C09D 163/00 | 428/327 |

* cited by examiner

METHOD FOR COATING A STRUCTURE WITH A FUSION BONDED MATERIAL

CROSS-REFERENCE TO RELATED APPLICATION

This application claims the benefit of the filing date of U.S. Provisional Patent Application Ser. No. 62/638,046, filed Mar. 2, 2018, which is hereby incorporated by reference in its entirety.

BACKGROUND

Steel wire products, such as concrete rebar and other steel structural elements, for example, steel mesh or lattice, are frequently used in reinforced concrete and reinforced masonry structures. Frequently, these steel reinforcing members are subject to corrosive conditions, such as those resulting from deicing salts applied to roadways or marine conditions, in addition to the alkalinity of the particular concrete mixture being used.

Galvanizing is a well-known treatment process to protect steel reinforcing members from corrosion when embedded in a cementitious medium. Galvanization is the process of coating steel or iron with zinc. The zinc preferentially reacts to the conditions causing corrosion (such as in the presence of an electrolyte) and thereby serves as a sacrifice to protect the steel from corroding instead. In particular, the zinc serves as a galvanic anode protecting the steel, known as cathodic protection. Cathodic, or galvanized, protection provides significant corrosion resistance, particularly given that even if the coating is scratched, abraded, or cut, thereby exposing the steel to the air and moisture, the exposed steel will still be protected from corrosion due to the galvanic action of the zinc in contact with the steel—an advantage absent from paint, enamel, powder coating and other methods. As such, galvanizing provides a relatively long maintenance-free service life, even in the event that portions of the coating are damaged.

Galvanization of a steel or iron product can be achieved in a number of ways, and the method of application is typically determined by the product to which it will be applied. Mill galvanizing applies a relatively thin coating during the steel product manufacturing process. In comparison, hot dipped galvanizing is performed by submerging a previously fabricated steel member or fabricated assembly, into a bath of molten zinc typically at a temperature of 860 degrees Fahrenheit. Hot-dip galvanizing deposits a relatively thick coating to the metal, however it is accompanied by certain manufacturing challenges, such as environmental and safety concerns, in addition to handling challenges.

Another means of protecting steel reinforcing members is to create a chemically-resistant mechanical-barrier coating on the steel member, thereby isolating the steel from the outside elements. For instance, fusion bonded epoxy coatings are commonly used to coat rebar used in reinforced concrete. Known techniques include heating the rebar to a melting temperature of an epoxy powder and then spray-coating the epoxy powder onto the heated rebar such that the latent heat of the rebar provides the energy to elevate the epoxy powder to the fusion temperature of the epoxy powder. The epoxy adheres to the rebar and is then cured into a hardened barrier.

However, in a steel lattice or mesh, where multiple steel members are assembled into a wire matrix reinforcement, such as by welding, spray-coating the resulting structure presents challenges. Further, spray-coating the individual components before assembling the wire matrix might not be effective, as welding the wires together afterwards creates discontinuities in the coating. For these reasons, the spray-coating individual components of a wire mesh reinforcement and other similar products is typically highly inefficient, resulting in excessive waste of the coating material, and thus added expense.

SUMMARY

In one aspect, an example method for coating a structure with a fusion bonded material is disclosed. The method includes (a) heating the structure to a melting temperature of the fusion bonded material, where the structure comprises a ratio of a surface area to an enclosed area of less than about 0.5, (b) submerging the heated structure in the fusion bonded material such that the fusion bonded material coats the structure, where the fusion bonded material is contained in a reservoir of a fluidization bed, and (c) removing the coated structure from the reservoir of the fluidization bed.

In another aspect, an example method for coating a wire matrix reinforcement is disclosed. The method includes (a) fluidizing an epoxy-based powder in a reservoir of a fluidization bed, where the fluidization bed comprises a base and a plurality of side walls, (b) heating the wire matrix reinforcement to at least a melting temperature of the epoxy-based powder, (c) submerging the heated wire matrix reinforcement into the fluidized epoxy-based powder such that the heated wire matrix reinforcement melts a portion of the epoxy-based powder, where the melted portion of the epoxy-based powder coats the wire matrix reinforcement, (d) removing the coated wire matrix reinforcement from the reservoir of the fluidization bed, and (e) curing the melted epoxy-based powder coating the wire matrix reinforcement into a corrosion resistant barrier.

In another aspect, an example system for coating a wire matrix reinforcement is disclosed. The system includes (a) a fluidization bed having a reservoir and comprising a base and a plurality of side walls, (b) an epoxy-based powder disposed within the reservoir of the fluidization bed, where the fluidization bed is configured to fluidize the epoxy-based powder, (c) a first heating element configured to heat the wire matrix reinforcement to at least a melting temperature of the epoxy-based powder, (d) a conveyor positioned over the fluidization bed and configured to engage the heated wire matrix reinforcement, where the conveyor is further configured to submerge the heated wire matrix reinforcement into the fluidized epoxy-based powder such that a portion of the epoxy-based powder melts and coats the wire matrix reinforcement, and where the conveyor is further configured to remove the coated wire matrix reinforcement from the fluidized epoxy-based powder; and (e) a second heating element configured to cure the melted epoxy-based powder coating the wire matrix reinforcement into a corrosion resistant barrier.

The features, functions, and advantages that have been discussed can be achieved independently in various examples or may be combined in yet other examples further details of which can be seen with reference to the following description and drawings.

Figure 1:
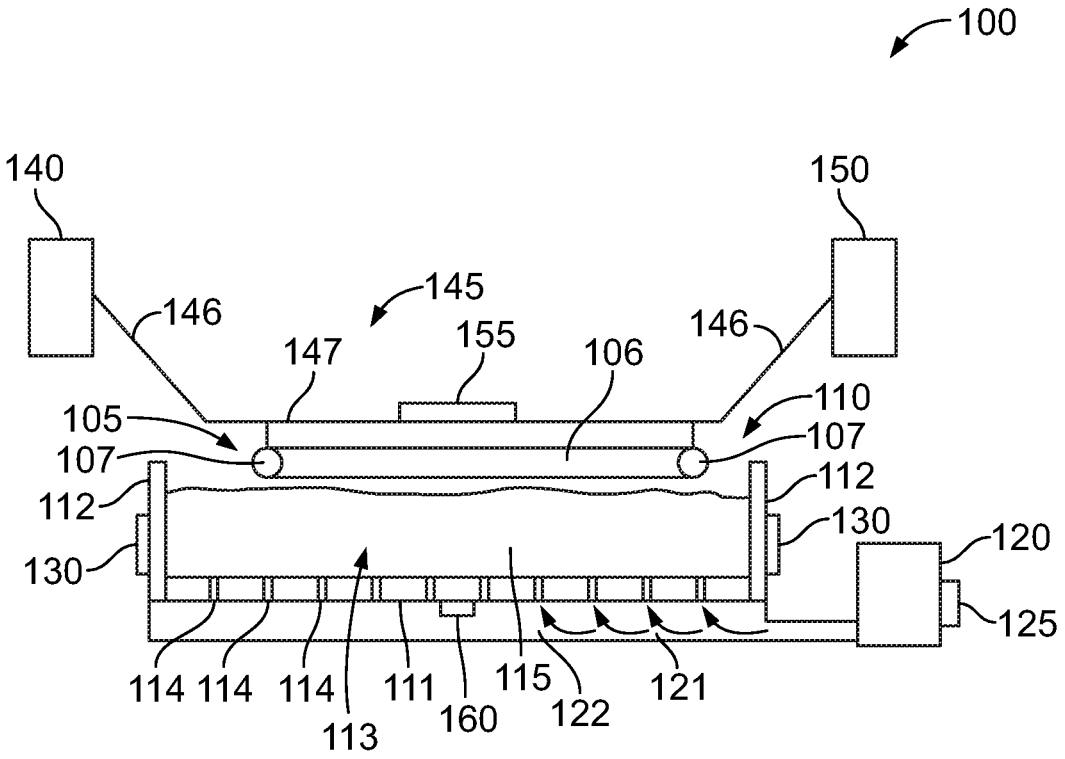
FIG. 1 is a side cross-sectional view of a system, according to one example implementation.

The drawings are for the purpose of illustrating examples, but it is understood that the inventions are not limited to the arrangements and instrumentalities shown in the drawings.

DETAILED DESCRIPTION

Embodiments of the methods and systems described herein advantageously permit coating of a structure having a relatively small surface area in relation to the enclosed area of the structure, such as a wire matrix reinforcing member. Other attendant benefits and advantages of the methods and systems will be appreciated with reference to the detailed disclosure that follows.

Figure 2:
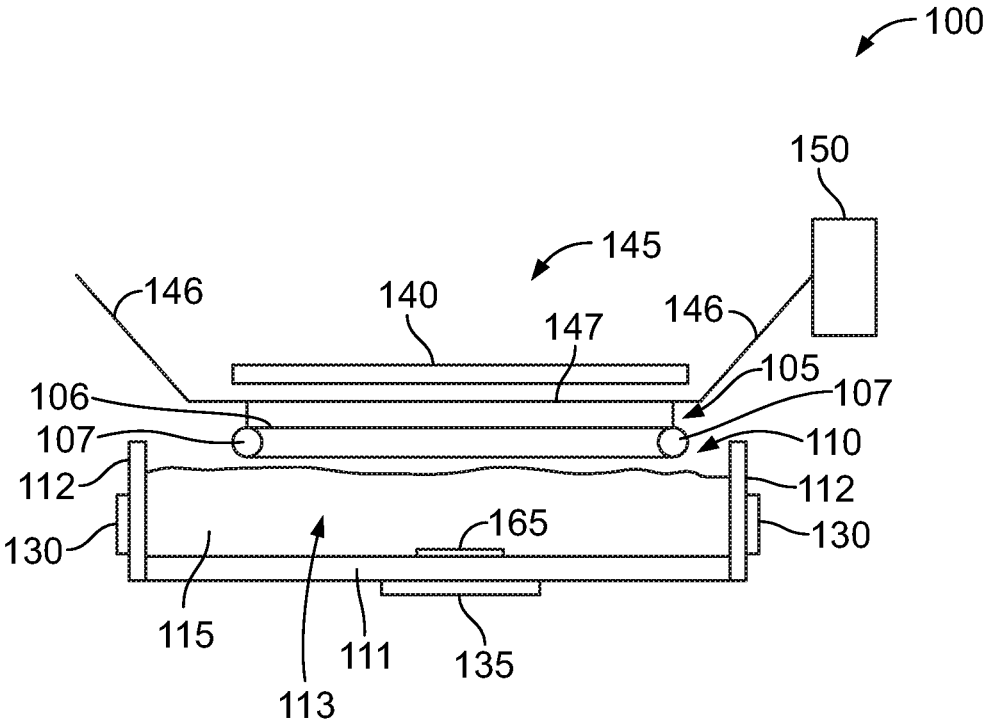
FIG. 2 is a side cross-sectional view of a system, according to one example implementation.

FIGS. 1-2 depict a system 100 for coating a structure in the form of a wire matrix reinforcement 105, where the system 100 includes a fluidization bed 110 having a base 111 and a plurality of side walls 112 that contain a reservoir 113. In one optional implementation, the wire matrix reinforcement 105 has a length of at least 120 inches and a width of at least 3 inches. In some example implementations, the reservoir of the fluidization bed may also be relatively large to accommodate the size of the wire matrix reinforcement. For instance, when used with a ladder wire structure described below, the fluidization bed may have a length of at least 96 inches and a width of at least 6 inches.

Figure 3:
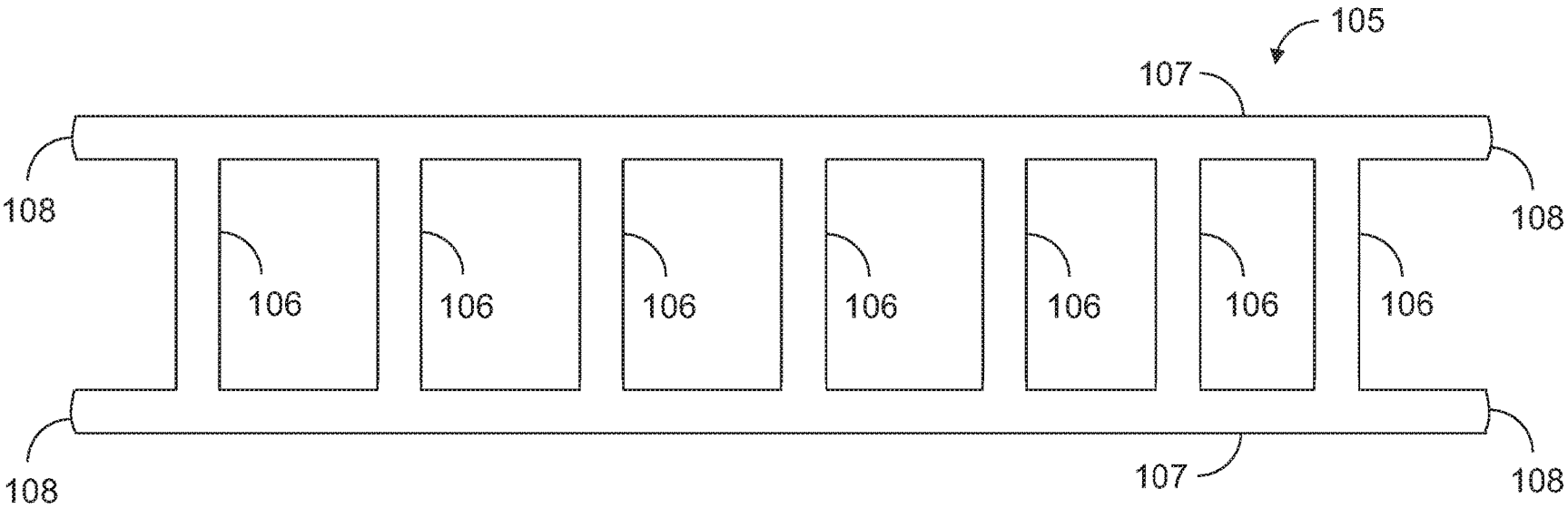
FIG. 3 is a top view of a wire matrix reinforcement, according to one example implementation.
Figure 4:
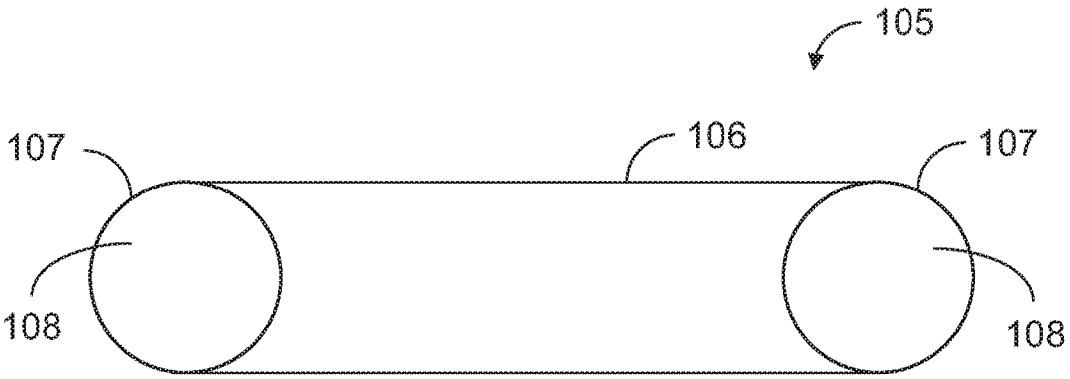
FIG. 4 is a front view of the wire matrix reinforcement shown in FIG. 3.

In another example implementation, the wire matrix reinforcement 105 includes a plurality of transverse wires 106 coupled to a plurality of longitudinal wires 107. This arrangement may be referred to as a ladder wire structure used, for example, in masonry construction with a plurality of transverse members connecting two parallel longitudinal members, as shown in FIG. 3. Each wire of the plurality of transverse wires 106 and the plurality of longitudinal wires 107 may optionally have a diameter of 0.25 inches or less. The plurality of transverse wires 106 and the plurality of longitudinal wires 107 may be coupled together via welding, soldering, or molding, for example.

The plurality of transverse wires 106 and the plurality of longitudinal wires 107 optionally include a galvanic protection layer. The technical effect of the galvanic protection layer is to prevent or minimize corrosion. For example, mill galvanizing may be used to provide a thin layer of corrosion protection that can be applied during the steel fabrication process for the plurality of transverse and longitudinal wires 106, 107. In addition, optionally applying a secondary epoxy coating, to mill-galvanized wire may provide an effective dual layer of protection over a majority of the wire matrix reinforcement 105. Further, at weld points between the plurality of transverse and longitudinal wires 106, 107 where mill-galvanized wire is coupled to form the wire matrix reinforcement 105, the corrosion protection of the mill galvanization may be compromised. Thus, the secondary epoxy coating may provide a corrosion resistant barrier that might otherwise be missing in these areas. Additionally, the secondary epoxy coating may serve to protect the overall structure of the wire matrix reinforcement 105 in the event of damage during handling that might remove small areas of epoxy coating, leaving the mill galvanization beneath intact.

In a further optional embodiment, the wire matrix reinforcement 105 has a ratio of a surface area to an enclosed area of less than about 0.5. In a further optional embodiment, the ratio of a surface area to an enclosed area is less than about 0.25. The surface area of the wire matrix reinforcement 105 refers to the total surface area of the structure, whereas the enclosed area corresponds to the overall area enclosed by the wire matrix reinforcement 105 (i.e., the area of an otherwise solid, continuous structure). For example, the enclosed area of the ladder wire structure would correspond to a rectangle based on the total length and width of the ladder wire structure (e.g., a solid, continuous footprint of the ladder wire structure). The enclosed area may be rather large in relation to the actual surface area to be coated. In other words, the enclosed area may be a predominantly empty space, and thus a large majority of the epoxy coating would not adhere to the wire matrix reinforcement 105 using previously known techniques like spray-coating thereby resulting in waste.

The increased effectiveness of disclosed system 100 for coating the wire matrix reinforcement 105 is illustrated with reference to the following example. For instance, a wire matrix reinforcement 105 in the form of a ladder wire structure may have a length of 10 feet, or 120 inches, and a width of 4 inches, for example. The ladder wire structure may be formed by two parallel longitudinal wires 107 of steel having a diameter of 0.25 inches coupled to 8 transverse wires 106 of steel with 16 inch spacing therebetween, also each having a diameter of 0.25 inches. This ladder wire structure may have a surface area of 213.63 $in^2$, while the enclosed area of the ladder wire structure is 577.39 $in^2$ based on a rectangle having the external dimensions and including the rounded edges 108 of the longitudinal wires (i.e., one quarter of the circumference of the longitudinal members). This produces a ratio of a surface area to an enclosed area of 0.40. Moreover, the ladder wire structure's surface area expressed above includes the entire circumference of each wire 106, 107 of the ladder wire structure. Accordingly, under known techniques, the ladder wire structure typically needs to be spray-coated from at least two opposing directions for proper coating with a fusion bonded material. As such, the enclosed area of the wire ladder structure is effectively doubled, and the resulting ratio is reduced by half to 0.20.

By comparison, a solid structure having the same length and width dimensions, such as a solid rectangular panel, would have the same enclosed area as the ladder wire structure discussed above. Further, the surface area to be coated would be the same or approximately the same as the enclosed area, resulting in a ratio of the surface area to the enclosed area of about 1.0. Further, the ratio is the same if both sides of the solid panel are to be coated, as both the surface area to be coated and the enclosed area are doubled. This ratio of approximately 1.0 may represent the efficiency of spray-coating the solid rectangular panel under known spray-coating techniques, as nearly all of the fusion bonded material that is sprayed toward the panel would adhere to the surface, and there would be minimal waste in the form of losses that may normally result from spray-coating along the edges of any structure.

Similarly, the substantially reduced ratio of 0.20 for the ladder wire structure above represents the inefficiency that would result from spray-coating such a structure. For instance, spray-coating both the top and bottom sides of the wire matrix reinforcement 105 may result in only about one fifth of the sprayed fusion bonded material adhering to and coating the structure (i.e., 80% waste). Further, reducing the diameter of the wire results in an even smaller ratio, and thus greater waste. For example, a similarly sized ladder wire structure formed from 9-gauge steel having a diameter of 0.148 inches has a surface area to enclosed area ratio of 0.12 when accounting for both sides of the structure, as discussed above. As such, submerging the wire matrix reinforcement in fusion bonded material 115 in the reservoir 113 of the fluidization bed 110, as discussed below, minimizes waste of the fusion bonded material 115 relative to other known techniques like spray-coating.

The system 100 also includes a fusion bonded material 115, such as an epoxy-based powder, thermoset powder or thermoplastic powder, disposed within the reservoir 113 of the fluidization bed 110. The fluidization bed 110 is configured to fluidize the epoxy-based powder 115. As used herein, "fluidize" refers to suspending particles of the fusion bonded material 115 (i.e., epoxy-based powder) within the air of the reservoir 113, in other words the fusion bonded material takes on the behavior of a fluid while the individual particles of the fusion bonded material remain solid. The technical effect of fluidizing the epoxy-based powder is to cause a mixture of solid particles to behave like a fluid.

For example, in one optional implementation shown in FIG. 1, the base 111 of the fluidization bed 110 includes a plurality of vents 114. In this implementation, the system 100 may include a blower 120 configured to introduce an air stream 121 into the reservoir 113 of the fluidization bed 110, via the plurality of vents 114, thereby fluidizing the epoxy-based powder 115. Specifically, the air stream 121 acts upon the epoxy-based powder causing the powder to be suspended in the air within the reservoir 113 of the fluidization bed 110. The air stream 121 may be advanced from the blower 120 to an air passage 122 coupled to the base 111 of the fluidization bed 110 and ultimately through the vents 114. In one optional implementation, the plurality of vents 114 may each be coupled to a valve or shutter (not shown) that opens when the blower 120 is powered on and that closes when the blower 120 is powered off to minimize or prevent epoxy-based powder from entering the air passage 122. The plurality of vents 114 may have a number of arrangements and be distributed along the length and width of the base 111 in a spaced apart manner to evenly distribute the air stream 121 along the base 111 of the fluidization bed 110.

Due to the relatively open geometry of the wire matrix reinforcement 105, the wire matrix reinforcement 105 may cool relatively quickly after being heated by the first heating element 140, described below, and before being submerged in the reservoir 113 of the fluidization bed 110. Therefore, in one optional implementation, the fusion bonded material 115 may also be heated within the reservoir 113 of the fluidization bed 110. For instance, the system 100 may optionally further include a third heating element 125 coupled to the blower 120, or alternatively to the air passage 122, and configured to heat the air stream 121 to an application temperature that is less than a melting temperature of the epoxy-based powder. As used herein, "melting temperature" refers to the temperature at which the fusion bonded material reaches a melting point and the fusion bonded material changes from a solid to a liquid state. As used herein, "application temperature" refers to a temperature close to but less than the melting temperature of the fusion bonded material to avoid spontaneous fusion in the fluidization bed. Heating the fusion bonded material to the application temperature may advantageously reduce the amount of heat that is lost from the wire matrix reinforcement 105 when submerged in the reservoir 113 of the fluidization bed 110 and may thereby reduce the amount of residual heat that must be stored in the wire matrix reinforcement 105 before being submerged. The third heating element 125, and all other heating elements described herein, may take the form of a metal heating element, a polymer PTC heating element, or a composite heating element, or any other heating element capable of emitting radiant heat, for example.

In a further optional implementation, the system 100 includes a fourth heating element 130 coupled to at least one of the plurality of side walls 112. The fourth heating element 130 is configured to heat at least one of the plurality of side walls 112 and/or the base 111 to an application temperature that is less than the melting temperature of the fusion bonded material. In another optional implementation, the fourth heating element 130 may radiantly heat the fusion bonded material without directly heating the base 111 and plurality of sidewalls 112 of the fluidization bed 110. The technical effect of the fourth heating element 130 is to decrease the time to heat the fusion bonded material to the application temperature and to improve temperature distribution throughout the fusion bonded material, as well as to account for heat losses in the heated wire matrix reinforcement 105.

In an alternative example implementation to fluidize the epoxy-based powder 115, the fluidization bed 110 may further include a vibrator 135 configured to impart a mechanical vibration to the fluidization bed 110. In operation, when vibration is imparted to the fluidization bed 110, the vibration causes the epoxy-based powder 115 to fluidize (i.e., to suspend or circulate within the air of the reservoir 113). The vibrator 135 may take the form of a piezoelectric vibrator or vibration motors, such as eccentric rotating mass ("ERM") motors and linear resonance actuators ("LRA").

The system 100 further includes a first heating element 140 configured to heat the wire matrix reinforcement 105 to at least a melting temperature of the epoxy-based powder 115. The technical effect of heating the wire matrix reinforcement 105 to at least the melting temperature of the fusion bonded material (i.e., epoxy-based powder) before submerging the wire matrix reinforcement 105 into the reservoir 113 of the fluidization bed 110 is to cause a portion of the fusion bonded material to melt and coat the surface of the wire matrix reinforcement 105. In one optional implementation, the first heating element 140 may take the form of a kiln or oven, for example. The heated wire matrix reinforcement 105 may then be transferred to a conveyor 145, discussed below.

In another optional implementation, the first heating element is coupled to the conveyor 145 in an arrangement such that heat radiates from the first heating element 140 and/or conveyor 145 and is absorbed by the wire matrix reinforcement 105. Alternatively, the heat from the first heating element 140 may be conducted through couplings between the conveyor 145 and the wire matrix reinforcement 105. As shown in FIG. 1, the first heating element 140 may be coupled to a lateral side edge 146 of the conveyor 145 and extend along the length of the conveyor 145 to evenly distribute heat. In an alternative implementation shown in FIG. 2, the first heating element 140 may be coupled to a base 147 of the conveyor and extend along the length of the conveyor to evenly distribute heat. As shown in FIGS. 1-2, in one optional implementation, the first heating element 140 may take the form of an induction heating unit that generates an alternating magnetic current to heat the wire matrix reinforcement 105. In some example implementations, the alternating magnetic current may not affect the fusion bonded material 115. In that case, the induction heating unit may be utilized while the wire matrix reinforcement 105 is submerged within the reservoir 113 of the fluidization bed 110. In this implementation, the first heating element 140 may be integrated into the conveyor 140.

The system 100 additionally includes a conveyor 145 positioned over the fluidization bed 110 and configured to engage the heated wire matrix reinforcement 105. As described above, the conveyor 145 has a base 147 and a pair of lateral sidewalls 146 that angle outwardly. The conveyor 145 is further configured to submerge the heated wire matrix reinforcement 105 into the fluidized epoxy-based powder 115 such that a portion of the epoxy-based powder 115 melts and coats the wire matrix reinforcement 105. The conveyor 145 is further configured to remove the coated wire matrix reinforcement 105 from the fluidized epoxy-based powder 115. For example, the conveyor 145 may be coupled to hydraulic or pneumatic supports to raise and lower the conveyor 145 relative to the fluidization bed 110. In alternative optional embodiments, the conveyor may take the form of a stage or a platform.

The system 100 further includes a second heating element 150 configured to cure the melted epoxy-based powder 115 coating the wire matrix reinforcement 105 into a corrosion resistant barrier. As shown in FIGS. 1-2, the second heating element 150 may be coupled to a lateral side edge 146 of the conveyor 145 and extend along the length of the conveyor 145 to evenly distribute heat. Alternatively, the second heating element may also take the form of a kiln or oven that receives the wire matrix reinforcement 105 after removal of the wire matrix reinforcement 105 from the reservoir 113 of the fluidization bed 110. In operation, the second heating element heats the wire matrix reinforcement 105 to a thermoset temperature for a predetermined amount of time to cure the epoxy-based powder. In one optional alternative implementation, the wire matrix reinforcement 105 may be cured via the first heating element 140.

In one optional implementation, the system 100 includes a first electrode 155 configured to induce a first electrostatic charge in the wire matrix reinforcement 105. The technical effect may beneficially increase adhesion of the fusion bonded material to the wire matrix reinforcement 105. For example, the first electrode 155 may induce the first electrostatic charge in the wire matrix reinforcement 105 before being submerged and may further continue to induce the charge as the structure is submerged in the fluidization bed. In another optional implementation, the system 100 includes a second electrode 160 coupled to the fluidization bed 110. In this implementation, the second electrode 160 is configured to induce a second electrostatic charge in the fluidized epoxy-based powder 115. Here, the first electrode 155 is coupled to the conveyor 150 and the second electrode 160 is arranged opposite to the first electrode 155.

In a further optional implementation, the system 100 includes a single electrode 165 coupled to the fluidization bed 110, and this electrode 165 is configured to induce an electrostatic charge in the fluidized epoxy-based powder 115. This single electrode 165 may be positioned within the reservoir 113 of the fluidization bed 110 to induce an electrostatic charge in the fluidized fusion bonded material 115, while the wire matrix reinforcement 105 may be grounded, for instance, through the conveyor 145.

Figure 5:
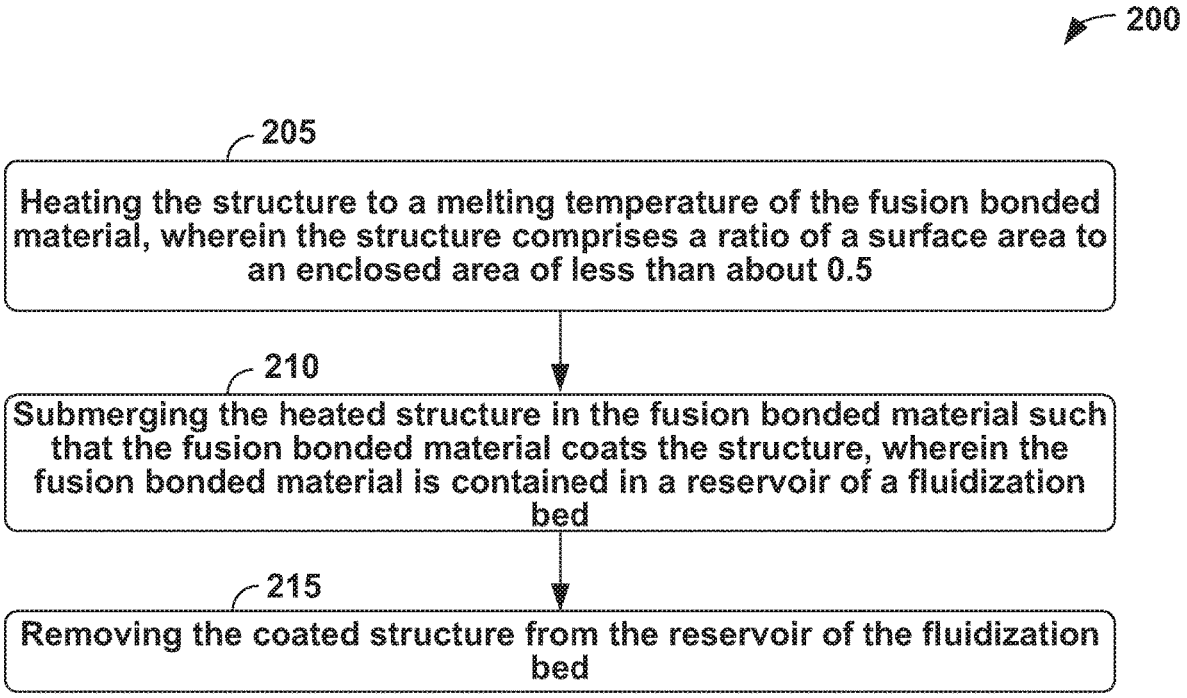
FIG. 5 shows a flowchart of a method, according to an example implementation.

Referring now to FIG. 5, a method 200 for coating a structure with a fusion bonded material is illustrated using the system 100 and wire matrix reinforcements 105 of FIGS. 1-4. Method 200 includes, at block 205, heating the structure 105 to a melting temperature of the fusion bonded material 115. In this example, the structure 105 has a ratio of a surface area to an enclosed area of less than about 0.5. In one optional embodiment, the structure 105 includes a wire matrix reinforcement 105 having a plurality of transverse wires 106 coupled to a plurality of longitudinal wires 107, as shown in FIG. 3. Then, at block 210, the heated structure 105 is submerged in the fusion bonded material 115 such that the fusion bonded material coats the structure 105. In this example, the fusion bonded material 105 is contained in a reservoir 113 of a fluidization bed 110. Next, at block 215, the coated structure 105 is removed from the reservoir 113 of the fluidization bed 110.

In one optional implementation, method 200 further includes a first heating element 140 heating the structure 105 to at least the melting temperature of the fusion bonded material 115 before submerging the structure 105 in the fusion bonded material 115. Then, after removing the structure 105 from the reservoir 113 of the fluidization bed 110, the second heating element 150 cures the fusion bonded material 115 coating the structure 105 into a corrosion resistant barrier.

In one optional implementation, the fluidization bed 110 includes a base 111 and a plurality of side walls 112. And method 200 further includes fluidizing the fusion bonded material 115 in the reservoir 113 of the fluidization bed 110. In this instance, fluidizing the fusion bonded material 115 includes suspending the fusion bonded material 115 in an air stream 121 introduced to the reservoir 113 of the fluidization bed 110 via a plurality of vents 114 in the base 111 of the fluidization bed 110. Then, before being introduced to the reservoir 113 of the fluidization bed 110, a third heating element 125 heats the air stream 121 to an application temperature that is less than the melting temperature of the fusion bonded material 115. In another implementation, fluidizing the fusion bonded material 115 in the fluidization bed 110 further includes vibrating the fluidization bed 110.

In one optional implementation, before submerging the heated structure 105 into the fluidized fusion bonded material 115, a fourth heating element 130 heats at least one of the plurality of side walls 112 of the fluidization bed 110 to an application temperature of the fusion bonded material 115 that is less than the melting temperature.

In one optional implementation, before submerging the heated structure 105 into the fluidized fusion bonded material 115, the first electrode 155 induces a first electrostatic charge in the structure 105. In one further optional implementation, before submerging the heated structure 105 into the fluidized fusion bonded material 115, a second electrode 160 coupled to the base 111 of the fluidization bed 110 induces a second electrostatic charge in the fluidized fusion bonded material 115. In this implementation, the first electrode 155 is suspended above the fluidization bed 110 and the second electrode 160 is arranged opposite to the first electrode 155.

In one optional implementation, before submerging the heated structure 105 into the fluidized fusion bonded material 115, the plurality of transverse wires are coupled to the plurality of longitudinal wires. In one optional implementation, before coupling the plurality of transverse wires 106 to the plurality of longitudinal wires 107, the plurality of transverse wires 106 and the plurality of longitudinal wires 107 are coated with a galvanic protection layer.

Figure 6:
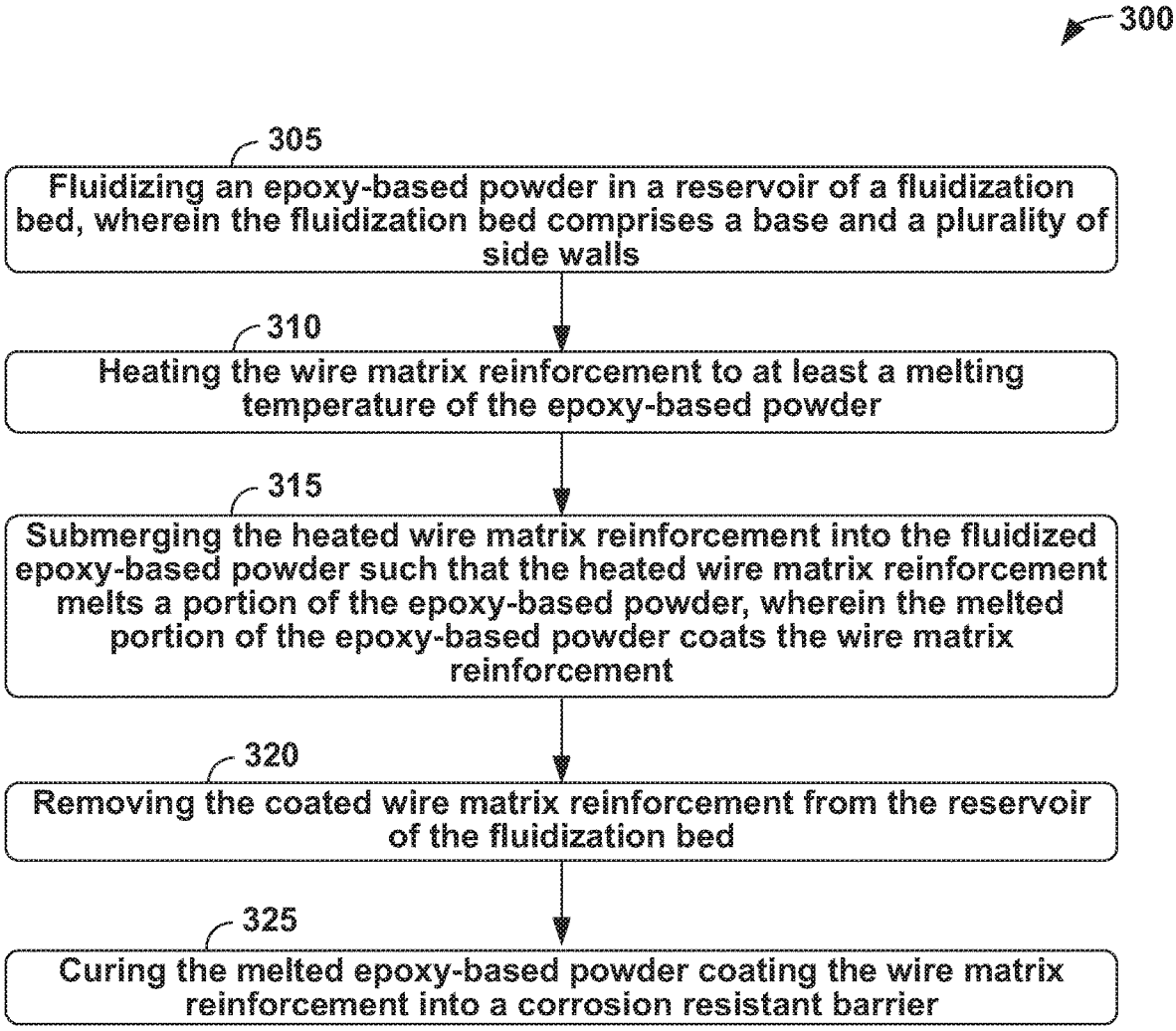
FIG. 6 shows a flowchart of a method, according to an example implementation.

Referring now to FIG. 6, a method 300 for coating a wire matrix reinforcement 105 is illustrated using the system 100 and wire matrix reinforcements 105 of FIGS. 1-4. Method 300 includes, at block 305, fluidizing an epoxy-based powder 115 in a reservoir 113 of a fluidization bed 110. In this example, the fluidization bed 110 includes a base 111 and a plurality of side walls 112. Next, at block 310, the wire matrix reinforcement 105 is heated to at least a melting temperature of the epoxy-based powder 115. In one optional implementation, the wire matrix reinforcement 105 may be heated via a first heating element 140. Then, at block 315, the heated wire matrix reinforcement 105 is submerged into the fluidized epoxy-based powder 115 such that the heated wire matrix reinforcement 105 melts a portion of the epoxy-based powder 115. In this example, the melted portion of the epoxy-based powder 115 coats the wire matrix reinforcement 105. At block 320, the coated wire matrix reinforcement 105 is removed from the reservoir 113 of the fluidization bed 110. Then, at block 325, the melted epoxy-based powder 115 coating the wire matrix reinforcement 105 is cured into a corrosion resistant barrier. In one optional implementation, the melted epoxy-based powder 115 coating the wire matrix reinforcement 105 is cured via a second heating element 150.

In various implementations, the wire matrix reinforcement 105 may be submerged in the fluidized epoxy-based powder 115 and removed from the reservoir 113 of the fluidization 110 either manually or via a conveyor or some other implementation, like a stage or platform.

In one implementation, method 300 further includes fluidizing the epoxy-based powder 115 in the fluidization bed 110 by suspending the epoxy-based powder 115 in an air stream 121 introduced to the reservoir 113 of the fluidization bed 110 via a plurality of vents 114 in the base 111 of the fluidization bed 110. Further, before being introduced to the reservoir 113 of the fluidization bed 110, a third heating element 125 heats the air stream 121 to an application temperature that is less than the melting temperature. In another implementation, fluidizing the epoxy-based powder 115 in the fluidization bed 110 includes vibrating the fluidization bed 110.

In one implementation, before submerging the heated wire matrix reinforcement 105 into the fluidized epoxy-based powder 115, a fourth heating element 130 heats at least one of the plurality of side walls 112 of the fluidization bed 110 to an application temperature that is less than the melting temperature of the epoxy-based powder 115.

In one implementation, before submerging the heated wire matrix reinforcement 105 into the fluidized epoxy-based powder 115, a first electrode 155 induces a first electrostatic charge in the wire matrix reinforcement 105. In another implementation, before submerging the heated wire matrix reinforcement 105 into the fluidized epoxy-based powder 115, a second electrode 160 coupled to the base 111 of the fluidization bed 110 induces a second electrostatic charge in the fluidized epoxy-based powder 115. In this example, the first electrode 155 is suspended above the fluidization bed 110 and the second electrode 160 is arranged opposite to the first electrode 155. In one implementation, before submerging the heated wire matrix reinforcement 105 into the fluidized epoxy-based powder 115, a single electrode 165 coupled to the fluidization bed 110 induces an electrostatic charge in the fluidized epoxy-based powder 115.

In one implementation, before submerging the heated wire matrix reinforcement 105 into the fluidized epoxy-based powder 115, the plurality of transverse wires 106 are coupled to the plurality of longitudinal wires 107. In one optional implementation, before coupling the plurality of transverse wires 106 with the plurality of longitudinal wires 107, the plurality of transverse wires 106 and the plurality of longitudinal wires 107 are coated with a galvanic protection layer.

The description of different advantageous arrangements has been presented for purposes of illustration and description, and is not intended to be exhaustive or limited to the examples in the form disclosed. Many modifications and variations will be apparent to those of ordinary skill in the art. Further, different advantageous examples may describe different advantages as compared to other advantageous examples. The example or examples selected are chosen and described in order to best explain the principles of the examples, the practical application, and to enable others of ordinary skill in the art to understand the disclosure for various examples with various modifications as are suited to the particular use contemplated.

The invention claimed is:

1. A method for coating a structure for reinforcement in masonry construction with a fusion bonded material, the method comprising:

heating, via a first heating element, the structure to at least a melting temperature of the fusion bonded material, wherein the structure comprises a ladder wire structure having a plurality of transverse members coupled to and extending between two longitudinal members arranged parallel to each other, wherein the ladder wire structure includes a galvanic protective layer, wherein the structure comprises a ratio of a surface area to an enclosed area of less than about 0.5;

after heating the structure to at least the melting temperature, submerging the heated structure in the fusion bonded material such that the fusion bonded material coats the structure, wherein the fusion bonded material is contained in a reservoir of a fluidization bed, wherein the fluidization bed comprises a base and a plurality of side walls;

before submerging the heated structure into the fluidized fusion bonded material, heating at least one of the plurality of side walls of the fluidization bed, via a fourth heating element, to an application temperature of the fusion bonded material that is less than the melting temperature;

fluidizing the fusion bonded material in the reservoir of the fluidization bed, wherein fluidizing the fusion bonded material comprises one or more of (i) suspending the fusion bonded material in an air stream introduced to the reservoir of the fluidization bed via a plurality of vents in the base of the fluidization bed, wherein, before being introduced to the reservoir of the fluidization bed, the air stream is heated to the application temperature, via a third heating element, and (ii) vibrating the fluidization bed;

removing the coated structure from the reservoir of the fluidization bed; and after removing the structure from the reservoir of the fluidization bed, curing, via a second heating element, the fusion bonded material coating the structure into a corrosion resistant barrier.

2. The method of claim 1, further comprising:

before submerging the heated structure into the fluidized fusion bonded material, inducing a first electrostatic charge in the structure via a first electrode.

3. The method of claim 2, the method further comprising:

before submerging the heated structure into the fluidized fusion bonded material, inducing a second electrostatic charge in the fluidized fusion bonded material via a second electrode coupled to the base of the fluidization bed, wherein the first electrode is suspended above the fluidization bed and the second electrode is arranged opposite to the first electrode.

4. A method for coating a wire matrix reinforcement for use in masonry construction, the method comprising:

fluidizing a powder in a reservoir of a fluidization bed, wherein the powder comprises an epoxy, wherein the fluidization bed comprises a base and a plurality of side walls, wherein fluidizing the powder in the fluidization bed comprises one or more of (i) suspending the powder in an air stream introduced to the reservoir of the fluidization bed via a plurality of vents in the base of the fluidization bed, wherein, before being introduced to the reservoir of the fluidization bed, the air stream is heated, via a heating element, to an application temperature that is less than the melting temperature, and (ii) vibrating the fluidization bed;

heating the wire matrix reinforcement to at least a melting temperature of the powder, wherein the wire matrix reinforcement comprises a ladder wire structure having a plurality of transverse members coupled to and extending between two longitudinal members arranged parallel to each other, wherein the wire matrix reinforcement includes a galvanic protective layer;

submerging the heated wire matrix reinforcement into the fluidized powder such that the heated wire matrix reinforcement melts a portion of the powder, wherein the melted portion of the powder coats the wire matrix reinforcement;

before submerging the heated wire matrix reinforcement into the fluidized powder, heating at least one of the plurality of side walls of the fluidization bed, via a heating element, to the application temperature;

removing the coated wire matrix reinforcement from the reservoir of the fluidization bed; and curing the melted powder coating the wire matrix reinforcement into a corrosion resistant barrier.

5. The method of claim 4, further comprising:

before submerging the heated wire matrix reinforcement into the fluidized powder, inducing a first electrostatic charge in the wire matrix reinforcement via a first electrode.

6. The method of claim 5, the method further comprising:

before submerging the heated wire matrix reinforcement into the fluidized powder, inducing a second electrostatic charge in the fluidized powder via a second electrode coupled to the base of the fluidization bed, wherein the first electrode is suspended above the fluidization bed and the second electrode is arranged opposite to the first electrode.

7. The method of claim 4, further comprising:

before submerging the heated wire matrix reinforcement into the fluidized powder, inducing an electrostatic charge in the fluidized powder via an electrode coupled to the fluidization bed.

* * * * *